US011730204B2

(12) United States Patent
Qiu

(10) Patent No.: US 11,730,204 B2
(45) Date of Patent: Aug. 22, 2023

(54) UPPER COVER ASSEMBLY, ATOMIZING DEVICE AND ELECTRONIC CIGARETTE

(71) Applicant: Changzhou Patent Electronic Technology Co., LTD., Changzhou (CN)

(72) Inventor: Weihua Qiu, Changzhou (CN)

(73) Assignee: CHANGZHOU PATENT ELECTRONIC TECHNOLOGY CO., LTD., Changzhou (CN)

( * ) Notice: Subject to any disclaimer, the term of this patent is extended or adjusted under 35 U.S.C. 154(b) by 644 days.

(21) Appl. No.: 16/449,276

(22) Filed: Jun. 21, 2019

(65) Prior Publication Data

US 2019/0307174 A1 Oct. 10, 2019

Related U.S. Application Data

(63) Continuation-in-part of application No. PCT/CN2017/093233, filed on Jul. 17, 2017.

(30) Foreign Application Priority Data

Dec. 21, 2016 (CN) ..... 201621406515.2

(51) Int. Cl.

| | |
|---|---|
| ***A24F 40/485*** | (2020.01) |
| ***A24F 40/10*** | (2020.01) |
| ***A24F 40/48*** | (2020.01) |
| ***A24F 9/16*** | (2006.01) |

(Continued)

(52) U.S. Cl.

CPC ..... *A24F 40/48* (2020.01); *A24F 9/16* (2013.01); *A24F 40/40* (2020.01); *A24F 40/485* (2020.01);

(Continued)

(58) Field of Classification Search

CPC ..... A24F 40/10; A24F 40/485

(Continued)

(56) References Cited

U.S. PATENT DOCUMENTS 9,795,169 B1 * 10/2017 Zhu ..... F16J 15/021
9,854,845 B2 * 1/2018 Plojoux ..... A61M 15/06

(Continued)

FOREIGN PATENT DOCUMENTS

CN 103519349 A 1/2014
CN 204599341 U 9/2015

(Continued)

OTHER PUBLICATIONS

Machine Translation of CN 204812051 (Year: 2014).*

(Continued)

*Primary Examiner* — Kelly M Gambetta
*Assistant Examiner* — Russell E Sparks
(74) *Attorney, Agent, or Firm* — Cheng-Ju Chiang

(57) ABSTRACT

An upper cover assembly includes an upper cover, a liquid filling cap movable relative to the upper cover between a usage position and a liquid filling position, and a mouthpiece. The upper cover is provided with a liquid filling hole and a smoke outlet hole. The liquid filling cap is provided with a through hole. The mouthpiece is integrally formed with the liquid filling cap and is in communication with the through hole. When the liquid filling cap is in the usage position, the liquid filling cap covers the liquid filling hole and the through hole is in communication with the smoke outlet hole. When the liquid filling cap is moved from the usage position to the liquid filling position, the liquid filling cap is displaced from the liquid filling hole and the liquid filling hole is opened.

12 Claims, 8 Drawing Sheets

(51) Int. Cl.
*B67D 7/02* (2010.01)
*A24F 40/40* (2020.01)
*A24F 15/015* (2020.01)

(52) U.S. Cl.
CPC ..... *B67D 7/0288* (2013.01); *A24F 15/015* (2020.01); *A24F 40/10* (2020.01)

(58) Field of Classification Search
USPC ..... 131/329
See application file for complete search history.

(56) References Cited

U.S. PATENT DOCUMENTS

| | | | | |
|---|---|---|---|---|
| 9,901,119 | B2 * | 2/2018 | Liu | A24F 40/42 |
| 10,602,779 | B2 * | 3/2020 | Chen | A24F 40/40 |
| 2011/0290248 | A1 * | 12/2011 | Schennum | B65D 83/30 128/202.21 |
| 2016/0029698 | A1 * | 2/2016 | Xiang | A24F 40/65 131/328 |

FOREIGN PATENT DOCUMENTS

| | | | |
|---|---|---|---|
| CN | 204812051 | U | 12/2015 |
| CN | 204888728 | U | 12/2015 |
| CN | 204949516 | U | 1/2016 |
| CN | 105326091 | A | 2/2016 |
| CN | 205284996 | U | 6/2016 |
| CN | 205305995 | U | 6/2016 |
| CN | 205358227 | U | 7/2016 |
| CN | 206251930 | U | 6/2017 |
| EP | 3550998 | A1 | 10/2019 |
| WO | 2016/082180 | A1 | 6/2016 |
| WO | 2018/113278 | A1 | 6/2018 |

OTHER PUBLICATIONS

Machine Translation of CN 205358227 (Year: 2016).*
Machine Translation of CN 206251930 (Year: 2017).*
Merriam Webster Dictionary, Definition of Dot, https://www.merriam-webster.com/dictionary/dot (Year: 2021).*

* cited by examiner

UPPER COVER ASSEMBLY, ATOMIZING DEVICE AND ELECTRONIC CIGARETTE

CROSS REFERENCE TO RELATED APPLICATIONS

This application is a continuation-in-part of International (PCT) Patent Application NO. PCT/CN2017/093233, filed on Jul. 17, 2017, which claims the priority of Chinese Patent Application No. 201621406515.2, filed on Dec. 21, 2016.

TECHNICAL FIELD

The present disclosure relates to the technical field of electronic cigarettes, and in particular, to an upper cover assembly, an atomizing device and an electronic cigarette.

BACKGROUND

Some of the conventional atomizers adopt the pushing method to open the liquid filling hole, for example, by pushing a cap to open and close the liquid filling hole, but the cap is generally disposed on an upper cover, and the user needs to press the upper surface of the cap to push the cap. If the cap is too loose, it will slip easily; if it is set too tight, the user can hardly push it with only the fingers, even if the anti-slip pattern is provided on the cap, the effect is not satisfactory. At the same time, since the volume of the electronic cigarette is small, the contact area between the finger and the cap is not large, which further increases the difficulty of pushing the cap.

SUMMARY

In view of the above, it is necessary to provide an upper cover assembly that facilitates liquid filling and facilitates the opening of the liquid filling cap.

It is also necessary to provide an atomizing device with the upper cover assembly.

It is further necessary to provide an electronic cigarette with the atomizing device.

An upper cover assembly includes an upper cover, a liquid filling cap movable relative to the upper cover between a usage position and a liquid filling position, and a mouthpiece. The upper cover is sequentially provided with a liquid filling hole and a smoke outlet hole on the path of the liquid filling cap moving from the usage position to the liquid filling position. The liquid filling cap is provided with a through hole. The mouthpiece is integrally formed with the liquid filling cap on a surface of the liquid filling cap away from the upper cover and is in communication with the through hole. When the liquid filling cap is in the usage position, the liquid filling cap covers the liquid filling hole and the through hole is in communication with the smoke outlet hole. When the liquid filling cap is moved from the usage position to the liquid filling position, the liquid filling cap is displaced from the liquid filling hole and the liquid filling hole is opened.

In one embodiment, the upper cover is provided with a sliding groove having an opening formed at one end thereof on both sides of the moving direction of the liquid filling cap. The liquid filling hole and the smoke outlet hole are sequentially provided between the two sliding grooves on the path of the liquid filling cap moving from the usage position to the liquid filling position. The liquid filling cap is slidably mounted in the sliding grooves through the openings.

In one embodiment, the liquid filling cap includes a cover body and two flanges extending outward from side edges of both sides of the cover body. The two flanges are slidably engaged in the two sliding grooves.

In one embodiment, at least one sliding groove is provided with two positioning grooves. The two positioning grooves are respectively located at the usage position and the liquid filling position of the liquid filling cap. The flange is protruded to form a positioning protrusion corresponding to the positioning groove. The positioning protrusion is selectively engaged and positioned in one of the two positioning grooves.

In one embodiment, one end of the upper cover away from the opening is provided with a receiving groove. The receiving groove connects two ends of the two sliding grooves away from the opening. The liquid filling cap includes a limiting edge formed by extending outward from a lower edge of the cover body. The limiting edge is located between the two flanges and is able to move into or out from the receiving groove. The cover body abuts against an inner wall of the receiving groove when the liquid filling cap is in the usage position.

In one embodiment, the upper cover includes a bottom cover and a pressing cover disposed above the bottom cover. The liquid filling hole and the smoke outlet hole are sequentially provided in the bottom cover on the path of the liquid filling cap moving from the usage position to the liquid filling position. The pressing cover is recessed inwardly from an edge away from the liquid filling hole to form a notch. The smoke outlet hole and the liquid filling hole are both received and exposed in the notch. A surface of the pressing cover facing the bottom cover is formed with two first recesses surrounding the notch and a second recess connected between the two first recesses. When the pressing cover is mounted on the bottom cover, the two first recesses and the second recess are enclosed by the bottom cover to form the two sliding grooves and the receiving groove.

In one embodiment, the bottom cover is provided with a sealing groove around the smoke outlet hole and the liquid filling hole. The upper cover assembly includes a sealing pad. The sealing pad is received in the sealing groove to seal around the outer periphery of the smoke outlet hole and the liquid filling hole.

In one embodiment, an outer periphery of the mouthpiece is provided with an anti-slip structure.

An atomizing device includes the above-mentioned upper cover assembly.

An electronic cigarette includes a battery device, a mouthpiece and an atomizing device, the mouthpiece is detachably mounted to the atomizing device, and the atomizing device is the above-mentioned atomizing device.

An upper cover assembly includes an upper cover and a liquid filling cap movable relative to the upper cover between a usage position and a liquid filling position. The upper cover is provided with a liquid filling hole on the path of the liquid filling cap moving from the usage position to the liquid filling position. When the liquid filling cap is in the usage position, the liquid filling cap covers the liquid filling hole. When the liquid filling cap is moved from the usage position to the liquid filling position, the liquid filling cap is displaced from the liquid filling hole and the liquid filling hole is opened.

In one embodiment, further including a smoke outlet hole, the liquid filling hole and the smoke outlet hole are sequentially provided in the upper cover on the path of the liquid filling cap moving from the usage position to the liquid filling position.

In one embodiment, further including a mouthpiece, the liquid filling cap is provided with a through hole, the mouthpiece is integrally formed with the liquid filling cap on a surface of the liquid filling cap away from the upper cover and is in communication with the through hole.

In one embodiment, the upper cover is provided with a sliding groove having an opening formed at one end thereof on both sides of the moving direction of the liquid filling cap. The liquid filling hole and the smoke outlet hole are sequentially provided between the two sliding grooves on the path of the liquid filling cap moving from the usage position to the liquid filling position. The liquid filling cap is slidably mounted in the sliding grooves through the openings.

In one embodiment, the liquid filling cap includes a cover body and two flanges extending outward from side edges of both sides of the cover body, and the two flanges are slidably engaged in the two sliding grooves.

In one embodiment, the upper cover is provided with two positioning grooves. The two positioning grooves are respectively located at the usage position and the liquid filling position of the liquid filling cap. The liquid filling cap is provided with a positioning protrusion. The positioning protrusion is selectively engaged and positioned in one of the two positioning grooves.

In one embodiment, at least one sliding groove is provided with two positioning grooves. The two positioning grooves are respectively located at the usage position and the liquid filling position of the liquid filling cap. The flange is protruded to form a positioning protrusion corresponding to the positioning groove. The positioning protrusion is selectively engaged and positioned in one of the two positioning grooves.

An atomizing device includes the above-mentioned upper cover assembly.

An electronic cigarette includes a battery device and an atomizing device, and the atomizing device is the above-mentioned atomizing device.

When the liquid filling cap of the electronic cigarette of the present disclosure is in the usage position, the smoke outlet hole communicates with the through hole, while the liquid filling hole is closed, such that the inhaling can be performed normally, but the liquid filling cannot be performed. When remaining amount of the cigarette liquid in the electronic cigarette is insufficient, since the mouthpiece and the liquid filling cap are integrally formed, the liquid filling cap can be moved from the usage position to the liquid filling position by pushing the mouthpiece, such that the liquid filling can be performed by the exposed liquid filling hole. It is convenient to operate.

Figure 1:
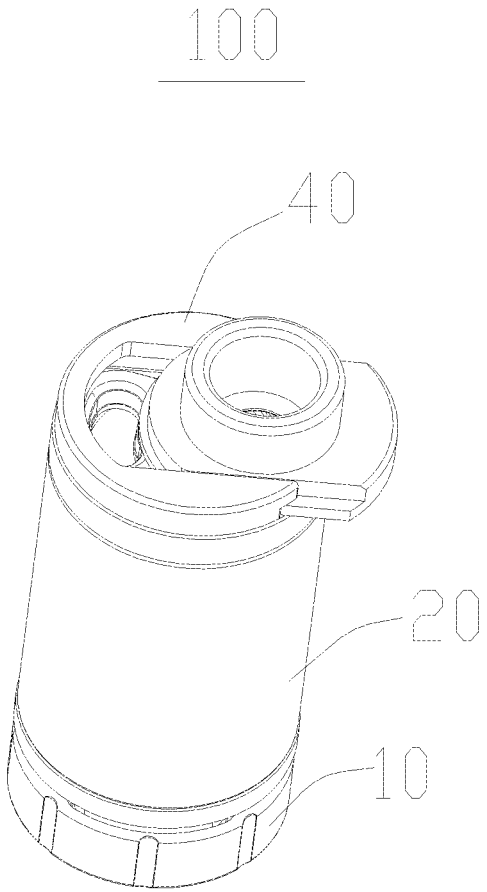
FIG. 1 is a schematic perspective view of an atomizing device in the present disclosure.

The part names and their reference signs in the drawings are:

| | |
|---|---|
| atomizing device 100 | base assembly 10 |
| base 11 | inner chamber 110 |
| air adjusting ring 13 | liquid storage tube 20 |
| liquid storage chamber 21 | atomizing assembly 30 |
| atomizing tube 31 | atomizing chamber 310 |
| liquid inlet hole 312 | upper cover assembly 40 |
| upper cover 41 | smoke outlet hole 410 |
| sliding groove 411 | opening 4110 |
| positioning grooves 4112 | liquid filling hole 412 |
| receiving groove 413 | bottom cover 414 |
| connecting cylinder 4141 | sealing groove 4143 |
| pressing cover 416 | notch 4161 |
| first recess 4162 | second recess 4163 |
| pin 417 | seal ring 418 |
| liquid filling cap 43 | through hole 430 |
| cover body 431 | flange 432 |
| positioning protrusion 4321 | limiting edge 434 |
| mouthpiece 45 | sealing pad 47 |
| cavity 451 | |

DETAILED DESCRIPTION OF PREFERRED EMBODIMENTS

In order to facilitate understanding of the present disclosure, the present disclosure will be described fully hereinafter with reference to the accompanying drawings. Preferred embodiments of the present disclosure are shown in the drawings. However, the present disclosure may be embodied in different forms and is not limited to the embodiments described herein. Rather, these embodiments are provided so that the understanding of the present disclosure may be more thorough.

It should be noted that when an element is referred to as being "fixed" to another element, it can be directly on another element or an intermediate element can be present. When an element is referred to as being "connected" to another element, it can be directly connected to another element or an intermediate element can be present.

Unless otherwise defined, all of the technical terms used herein have the same meaning as commonly understood by one of ordinary skill in the art to the present disclosure. The terminology used in the description of the present disclosure is used only for the purpose of describing particular embodiments and not intended to limit the present disclosure. The term "and/or" used herein includes any and all combinations of one or more of the listed items.

Figure 2:
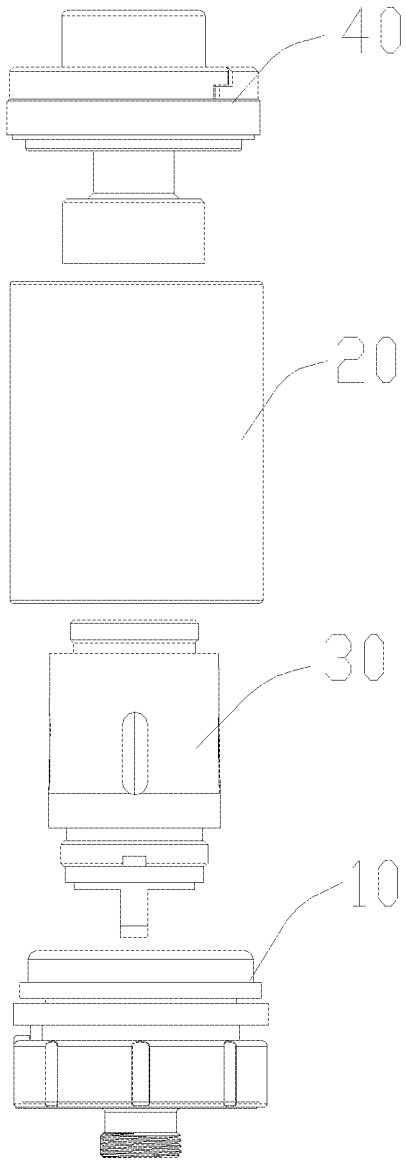
FIG. 2 is an exploded view of the atomizing device of FIG. 1.
Figure 3:
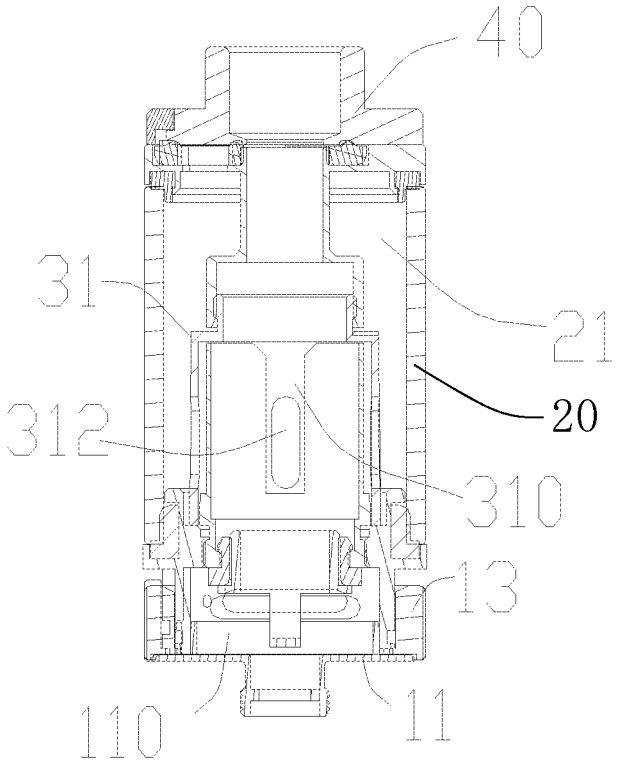
FIG. 3 is an axial cross-sectional view of the atomizing device of FIG. 1.

Referring to FIG. 1, FIG. 2 and FIG. 3, in one embodiment of the present disclosure, an electronic cigarette (not shown) includes an atomizing device 100 and a battery device (not shown) for electrically driving the atomizing device 100. The atomizing device 100 includes a base assembly 10, a liquid storage tube 20, an atomizing assembly 30 with an atomizing chamber 310, and an upper cover assembly 40. The liquid storage tube 20 is sleeved on the base assembly 10 and the two together surrounds a liquid storage chamber 21 for storing cigarette liquid. The atomizing assembly 30 is received in the liquid storage chamber 21 for atomizing the cigarette liquid. The upper cover assembly 40 is disposed at one end of the liquid storage tube 20 opposite to the base assembly 10, and is in communication selectively with the atomizing chamber 310 and the liquid storage chamber 21. When the upper cover assembly 40 is in communication with the atomizing chamber 310, the user can inhale the atomized smoke. When the upper cover assembly 40 is in communication with the liquid storage chamber 21, the air pressure in the liquid storage chamber 21 is maintained stable to prevent liquid leakage and the user can perform liquid filling operation.

Specifically, the base assembly 10 is generally hollow cylindrical and includes a base 11 with an inner chamber 110 and an air adjusting ring 13. The base 11 has a substantially hollow cylindrical shape, and an air inlet hole (not shown) communicating with the inner chamber 110 is defined in the circumferential wall thereof. The air adjusting ring 13 is rotatably sleeved on the outer circumference of the base 11, and is provided with an air adjustment groove (not shown) communicating with the outside environment. The air adjustment groove communicates with or is misaligned with the air inlet hole. When the air adjusting ring 13 is rotated, the communication area between the air adjustment groove and the air inlet hole can be adjusted, so that the user can adjust the air intake amount as needed.

The liquid storage tube 20 is a hollow tube with openings at both ends. Optionally, it is a glass tube or a stainless-steel tube. The liquid storage tube 20 is sleeved outside the base 11, and the liquid storage chamber 21 for storing the cigarette liquid is formed as being surrounded cooperatively by the liquid storage tube 20 and the base 11.

The atomizing assembly 30 is received in the liquid storage chamber 21. The atomizing assembly 30 includes an atomizing tube 31, a heating member (not shown), a liquid guiding member (not shown), and an electrode contact assembly (not shown). The atomizing tube 31 is opened at the upper and lower ends, and an atomizing chamber 310 is defined therein. The atomizing tube 31 is provided with a liquid inlet hole 312 communicating the liquid storage chamber 21 with the atomizing chamber 310. The heating member and the liquid guiding member are disposed in the atomizing tube 31 for absorbing the cigarette liquid in the liquid storage chamber 21 and heating and atomizing the cigarette liquid under the electric driving of the battery device. The heating member may be a heating wire, and the liquid guiding member may be a liquid guiding cotton; and the two may be arranged such that the liquid guiding cotton is wrapped around the heating wire, or the heating wire is wrapped around the liquid guiding cotton. The electrode contact assembly is disposed at the bottom of the atomizing tube 31. One end of the electrode contact assembly is electrically connected to the heating member, and the other end is electrically connected to the battery device, so as to provide electrical driving for the atomizing assembly 30.

The external air enters the inner chamber 110 of the base 11 from the air adjustment groove of the air adjusting ring 13 and the air inlet hole of the base 11, then enters the atomizing chamber 310 from the lower opening of the atomizing tube 31 wherein the cigarette liquid in the atomizing chamber 310 is atomized into smoke, and finally flows into the upper cover assembly 40 from the top opening of the atomizing tube 31 for the user to inhale.

Figure 4:
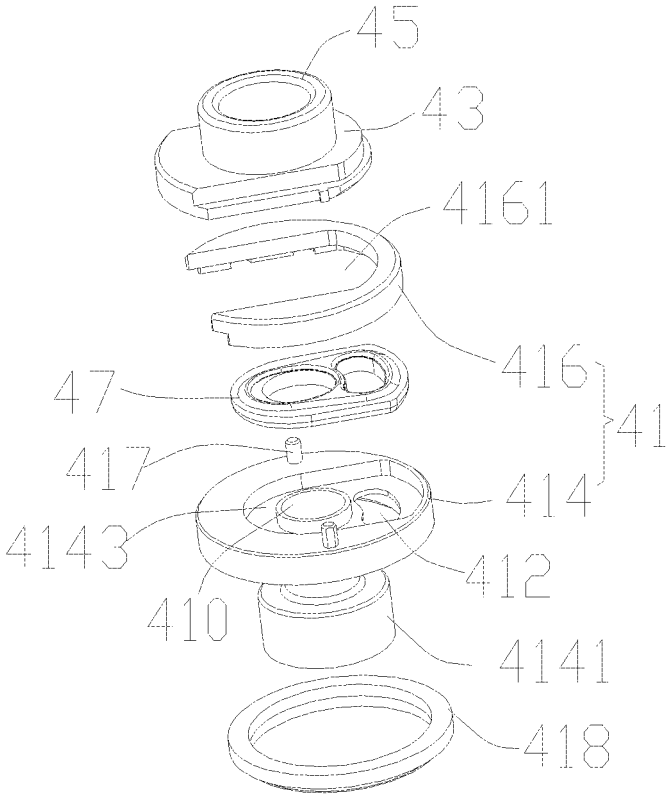
FIG. 4 is an exploded view of the upper cover assembly of the atomizing device of FIG. 1.
Figure 5:
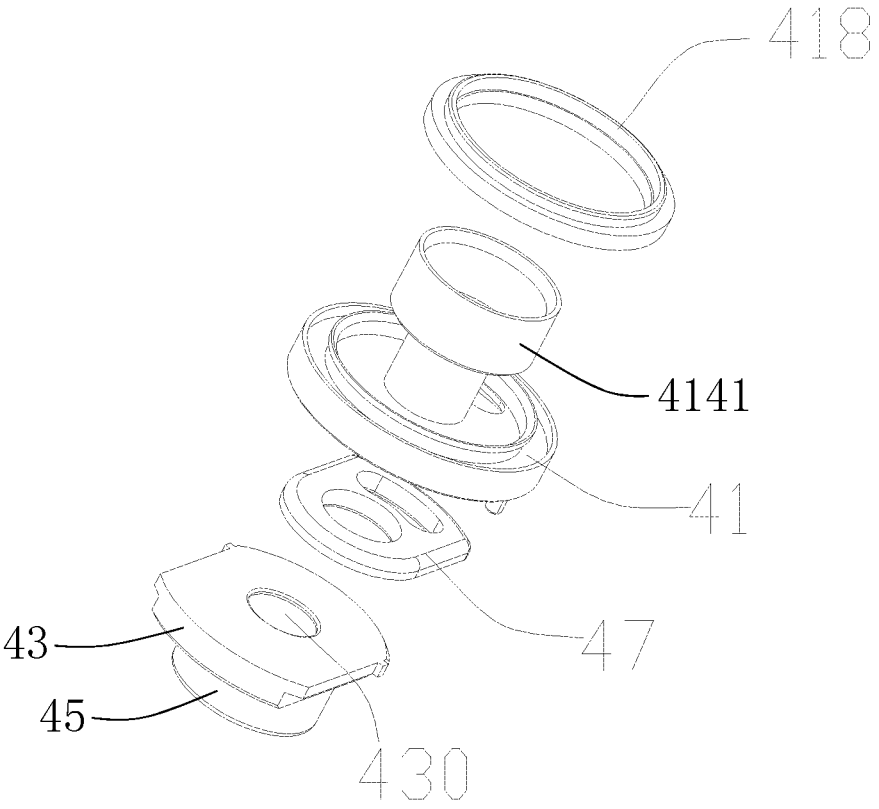
FIG. 5 is an exploded view of the upper cover assembly of the atomizing device of FIG. 4 from another viewing angle.
Figure 8:
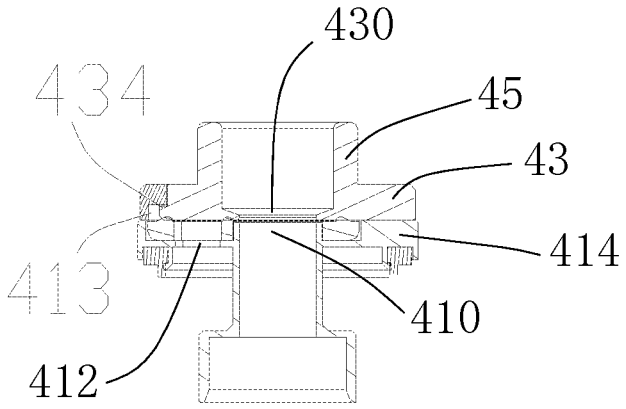
FIG. 8 is a cross-sectional view of the upper cover assembly of FIG. 4 when the liquid filling cap is in the usage position.
Figure 9:
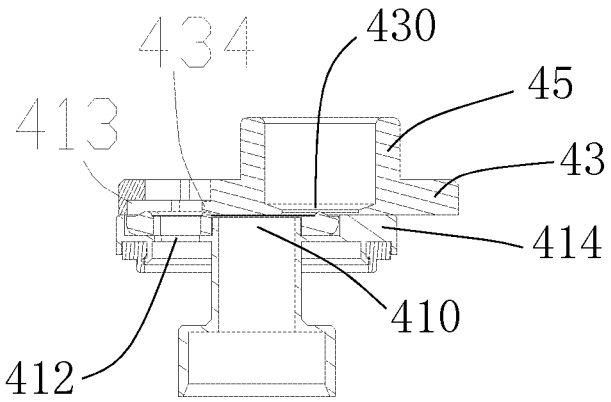
FIG. 9 is a cross-sectional view of the upper cover assembly of FIG. 4 when the liquid filling cap is in the liquid filling position.

Referring to FIG. 4 and FIG. 5, the upper cover assembly 40 includes an upper cover 41, a liquid filling cap 43 movable relative to the upper cover 41 between the usage position and the liquid filling position, and a mouthpiece 45. The upper cover 41 is sequentially provided with a liquid filling hole 412 and a smoke outlet hole 410 on the path of the liquid filling cap 43 moving from the usage position (as shown in FIG. 8) to the liquid filling position (as shown in FIG. 9). The liquid filling cap 43 is provided with a through hole 430. The mouthpiece 45 is integrally formed with the liquid filling cap 43 on the surface of the liquid filling cap 43 away from the upper cover 41 and is in communication with the through hole 430. When the liquid filling cap 43 is in the usage position, the liquid filling cap 43 covers the liquid filling hole 412 and the through hole 430 communicates with the smoke outlet hole 410. When the liquid filling cap 43 is moved from the usage position to the liquid filling position, the liquid filling cap 43 is displaced from the liquid filling hole 412 and the liquid filling hole 412 is opened.

In this way, when the electronic cigarette is in use, the through hole 430 of the liquid filling cap 43 is in communication with the smoke outlet hole 410 in the usage position, so that the atomized smoke in the atomizing chamber 310 flows out through the through hole 430 into the mouthpiece 45 for the user to inhale. At this time, the liquid filling hole 412 is closed, and the liquid filling operation cannot be performed. When the liquid filling operation is required, the liquid filling hole 412 is opened directly by moving the mouthpiece 45, so that the liquid filling hole 412 is exposed, to ensure that the air pressure in the liquid storage chamber 21 is stabilized by pressure relief, thereby avoiding liquid leakage due to change of the air pressure in the liquid storage chamber 21 when the liquid filling cap 43 is opened suddenly; and at the same time, the liquid filling operation can be performed. After the liquid filling operation is finished, the mouthpiece 45 is pushed again to close the liquid filling hole 412. It is very convenient.

Figure 6:
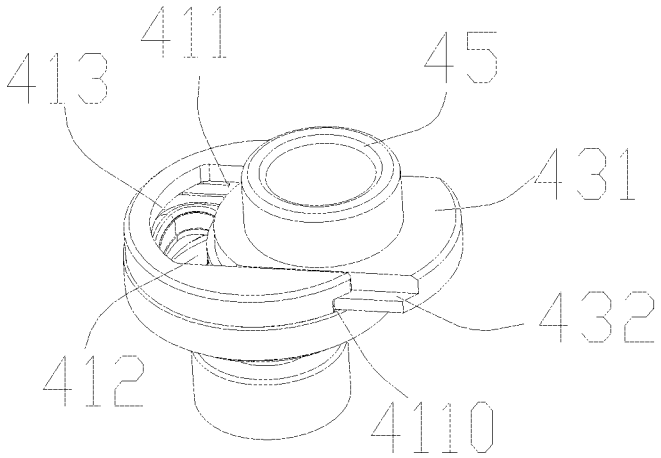
FIG. 6 is a schematic view showing the liquid filling cap of the upper cover assembly of FIG. 4 opened relative to the upper cover.

Referring to FIG. 6, specifically, the upper cover 41 is provided with a sliding groove 411 having an opening 4110 formed at one end thereof on both sides of the moving direction of the liquid filling cap 43. The liquid filling hole 412 and the smoke outlet hole 410 are sequentially provided between the two sliding grooves 411 along the direction of the liquid filling cap 43 moving from the usage position to the liquid filling position. The liquid filling cap 43 is slidably mounted in the sliding grooves 411 through the openings 4110, so that the liquid filling hole 412 is opened when the liquid filling cap 43 slides out of the sliding grooves 411 from the openings 4110, and the liquid filling hole 412 is closed when the liquid filling cap 43 slides into the sliding grooves 411 from the openings 4110.

The liquid filling cap 43 includes a cover body 431 and two flanges 432 on opposite sides of the cover body 431. The cover body 431 is substantially elongated, the two flanges 432 are extended outward from side edges of the cover body 431, and the two flanges 432 are slidably engaged in the two sliding grooves 411, to cause the cover body 431 to open or close the liquid filling hole 412.

Figure 7:
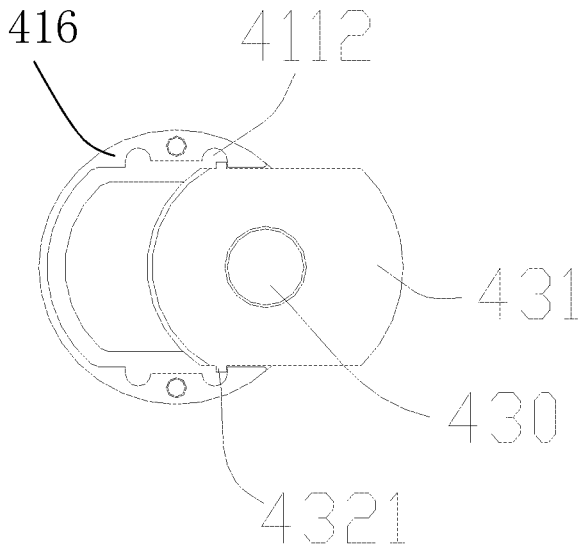
FIG. 7 is a bottom view of the liquid filling cap and the pressing cover when the liquid filling cap of the upper cover assembly of FIG. 6 is in the liquid filling position.

FIG. 7 is a bottom view showing the liquid filling cap 43 in the liquid filling position in this embodiment. Further, in order to position the liquid filling cap 43 better in the usage position and in the liquid filling position, at least one sliding groove 411 is provided with two positioning grooves 4112. The two positioning grooves 4112 are respectively located at the usage position and the liquid filling position of the liquid filling cap 43. The flange 432 is protruded to form a positioning protrusion 4321 corresponding to the positioning groove 4112. The positioning protrusion 4321 is selectively engaged and positioned in one of the two positioning grooves 4112.

Referring to FIG. 6, FIG. 8 and FIG. 9, one end of the upper cover 41 away from the openings 4110 is provided with a receiving groove 413. The receiving groove 413 connects two ends of the two sliding grooves 411 away from the openings 4110. The liquid filling cap 43 includes a limiting edge 434 formed by extending outward from the lower edge of the cover body 431. The limiting edge 434 is located between the two flanges 432 and can move into or out from the receiving groove 413. When the liquid filling cap 43 is moved to the usage position relative to the upper cover 41, the limiting edge 434 is received in the receiving groove 413 and the cover body 431 abuts against the inner wall of the receiving groove 413, thereby preventing the liquid filling cap 43 from turning over relative to the upper cover 41. When the liquid filling cap 43 is moved to the liquid filling position relative to the upper cover 41 (as shown in FIG. 9), the limiting edge 434 is moved out of the receiving groove 413 to expose the liquid filling hole 412.

Referring to FIG. 4 again, in this embodiment, the upper cover 41 includes a bottom cover 414 and a pressing cover 416 disposed above the bottom cover 414. The liquid filling hole 412 and the smoke outlet hole 410 are sequentially provided in the bottom cover 414 on the path of the liquid filling cap 43 moving from the usage position to the liquid filling position. The bottom cover 414 is disposed at one end of the liquid storage tube 20 away from the base assembly 10. A surface of the bottom cover 414 away from the pressing cover 416 is formed outwardly with a hollow connecting cylinder 4141. The connecting cylinder 4141 is inserted at one end of the atomizing tube 31 away from the base 11 for fixing the upper cover assembly 40 and the atomizing assembly 30 and allowing the smoke in the atomizing chamber 310 to pass through. In addition, the upper cover assembly 41 further includes a seal ring 418 disposed between the bottom cover 414 and the liquid storage tube 20 for preventing smoke leakage.

Figure 10:
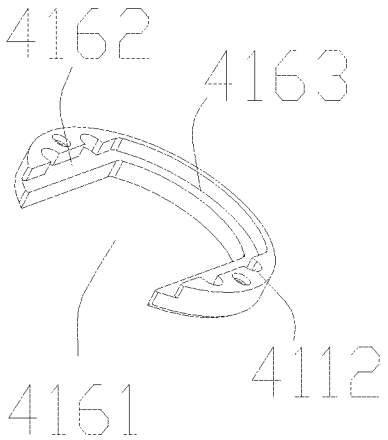
FIG. 10 is a schematic view of the pressing cover of the upper cover assembly of FIG. 4 from another viewing angle.

Referring also to FIG. 10, the pressing cover 416 is substantially in the shape of a horseshoe. The pressing cover 416 is recessed inwardly from the edge away from the liquid filling hole 412 to form a notch 4161. Specifically, the pressing cover 416 includes a disk-shaped main body, the side edge of the disc-shaped main body away from the liquid filling hole 412 is recessed inwardly through upper and lower surfaces to form a U-shaped notch 4161. The smoke outlet hole 410 and the liquid filling hole 412 are both received and exposed in the notch 4161. The surface of the pressing cover 416 facing the bottom cover 414 is provided with two first recesses 4162 surrounding the notch 4161 and a second recess 4163 connected between the two first recesses 4162, so that when the pressing cover 416 is mounted on the bottom cover 414, the two first recesses 4162 and the second recess 4163 are enclosed by the bottom cover 414 to form the two sliding grooves 411 and the receiving groove 413. The two sliding grooves 411 are elongated along the moving direction of the liquid filling cap 43, one end of each sliding groove 411 is connected to the receiving groove 413, and the other end of each sliding groove 411 away from the receiving groove 413 is open for a corresponding flange 432 of the liquid filling cap 43 to move in or out. At the same time, one edge of each sliding groove 411 facing the notch 4161 is also open, so that the liquid filling cap 43 can open or close the notch 4161 through the two flanges 432.

In this way, each sliding groove 411 faces the notch 4161 with a U-shaped cross-section, so that when the flanges 432 are engaged in the corresponding sliding grooves 411, the flanges 432 can move along the horizontal extending direction of the sliding grooves 411 while being limited in the vertical direction. In addition, each sliding groove 411 is provided with two positioning grooves 4112 on the side away from the notch 4161, and the two positioning grooves 4112 are provided in the side wall of the corresponding first recess 4162 and are recessed away from the notch 4161 to be arc-shaped. The positioning protrusions 4321 are formed by protruding from corresponding positions of the flange 432 away from the cover body 431. It is to be understood that, in other embodiments, the positioning grooves 4112 may be provided at the top wall of the first recess 4162, and the positioning protrusions 4321 may be correspondingly provided on the top surface of the flange 432, but it is not limited herein.

Referring back to FIG. 4, in this embodiment, the upper cover 41 includes a pin 417. The pin 417 passes through the bottom cover 414 and is fixed to the pressing cover 416, such that the bottom cover 414 and the pressing cover 416 are fixed. It is to be understood that in other embodiments, the manner through which the pressing cover 416 and the bottom cover 414 are fixed may be selected as needed, or the two may be integrally formed, but it is not limited herein.

The mouthpiece 45 protrudes out from the surface of the cover body 431 of the liquid filling cap 43 away from the bottom cover 414, and communicates with the through hole 430. Further, in order to more conveniently push the liquid filling cap 43, the outer periphery of the mouthpiece 45 is provided with an anti-slip structure, such as dots or an anti-slip pattern.

Further, in order to ensure the tightness between the pressing cover 416 and the liquid filling cap 43, the bottom cover 414 is provided with a sealing groove 4143 around the smoke outlet hole 410 and the liquid filling hole 412. The upper cover assembly 40 includes a sealing pad 47, and the sealing pad 47 is received in the sealing groove 4143 to seal around the outer periphery of the smoke outlet hole 410 and the liquid filling hole 412.

When the liquid filling cap 43 of the electronic cigarette of the present disclosure is in the usage position, the smoke outlet hole 410 communicates with the through hole 430, while the liquid filling hole 412 is closed, such that the inhaling can be performed normally, but the liquid filling cannot be performed. When remaining amount of the cigarette liquid in the electronic cigarette is insufficient, since the mouthpiece 45 and the liquid filling cap 43 are integrally formed, the liquid filling cap 43 can be moved from the usage position to the liquid filling position by pushing the mouthpiece 45, such that the liquid filling can be performed by the exposed liquid filling hole 412. It is convenient to operate.

Figure 11:
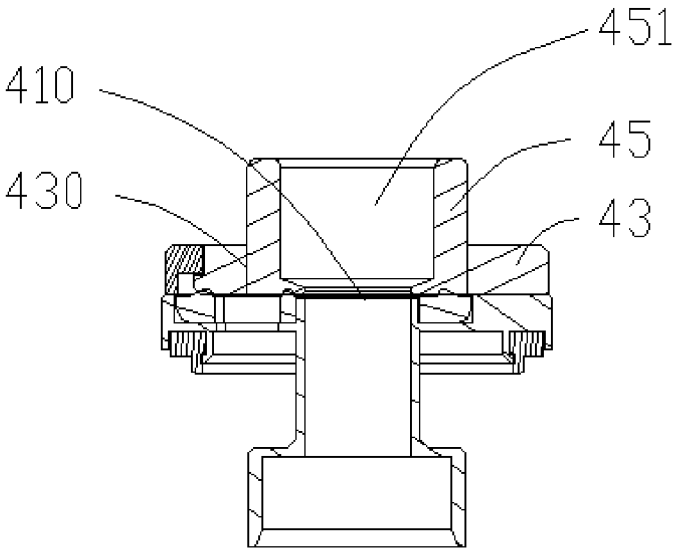
FIG. 11 is a cross-sectional view of an upper cover assembly of the atomizing device of FIG. 1.

In one embodiment, the mouthpiece 45 is detachably and fixedly connected with the liquid filling cap 43, so the mouthpiece 45 can be detached not only from the liquid filling cap 43 but also when the liquid filling cap 43 is pushed, the mouthpiece 45 can be moved together, or when the mouthpiece 45 is pushed, the liquid filling cap 43 can be moved together. Referring to FIG. 11, the mouthpiece 45 is a hollow cylindrical structure with two ends running through, and a cavity 451 for the flow of smoke is formed therein. The lower end of the mouthpiece 45 is inserted into the through hole 430, and the cavity 451 of the mouthpiece 45 communicates with the through hole 430, in order to facilitate the flow of smoke from the through hole 430 into the cavity 451 of the mouthpiece 45, and finally flow out from the upper end of the mouthpiece 45. In other embodiments, the mouthpiece 45 can also be magnetically connected, snapped, or screwed with the liquid filling cap 43, but it is not limited herein. The shape of the mouthpiece 45 may be a rectangular parallelepiped, a cylinder, or the like, and is not limited herein.

The above-mentioned embodiments are merely illustrative of several embodiments of the present disclosure, and the description thereof is much specific and detailed, but is not to be construed as limiting the scope of the present disclosure. It should be noted that a number of variations and modifications may be made by those skilled in the art without departing from the spirit and scope of the present disclosure. Therefore, the scope of the present disclosure should be determined by the appended claims.

What is claimed is:

1. An upper cover assembly, comprising an upper cover and a liquid filling cap movable relative to the upper cover between a usage position and a liquid filling position, wherein the upper cover is provided with a liquid filling hole on the path of the liquid filling cap moving from the usage position to the liquid filling position, when the liquid filling cap is in the usage position, the liquid filling cap covers the liquid filling hole, when the liquid filling cap is moved from the usage position to the liquid filling position, the liquid filling cap is displaced from the liquid filling hole and the liquid filling hole is opened;

the upper cover is further provided with a smoke outlet hole, the liquid filling hole and the smoke outlet hole are sequentially provided in the upper cover on the path of the liquid filling cap moving from the usage position to the liquid filling position;

the upper cover is provided with two sliding grooves on both sides of the moving direction of the liquid filling cap, each sliding groove having an opening formed at one end thereof, the liquid filling hole and the smoke outlet hole are sequentially provided between the two sliding grooves on the path of the liquid filling cap moving from the usage position to the liquid filling position, the liquid filling cap is slidably mounted in the sliding grooves through the openings;

the liquid filling cap comprises a cover body and two flanges extending outward from side edges of both sides of the cover body, and the two flanges are slidably engaged in the two sliding grooves;

one end of the upper cover away from the openings is provided with a receiving groove, the receiving groove connects two ends of the two sliding grooves away from the openings, the liquid filling cap includes a limiting edge formed by extending outward from a lower edge of the cover body, the limiting edge is located between the two flanges and is able to move into or out from the receiving groove, the cover body abuts against an inner wall of the receiving groove when the liquid filling cap is in the usage position.

2. The upper cover assembly according to claim 1, further comprising a mouthpiece, wherein the liquid filling cap is provided with a through hole, the mouthpiece is integrally formed with the liquid filling cap on a surface of the liquid filling cap away from the upper cover and is in communication with the through hole.

3. The upper cover assembly according to claim 1, wherein the upper cover is provided with two positioning grooves, the two positioning grooves are respectively located at the usage position and the liquid filling position of the liquid filling cap; the liquid filling cap is provided with a positioning protrusion, the positioning protrusion is selectively engaged and positioned in one of the two positioning grooves.

4. The upper cover assembly according to claim 1, wherein at least one of the sliding grooves is provided with two positioning grooves, the two positioning grooves are respectively located at the usage position and the liquid filling position of the liquid filling cap; the flange is protruded to form a positioning protrusion corresponding to the positioning groove, the positioning protrusion is selectively engaged and positioned in one of the two positioning grooves.

5. The upper cover assembly according to claim 1, wherein the upper cover comprises a bottom cover and a pressing cover disposed above the bottom cover, the liquid filling hole and the smoke outlet hole are sequentially provided in the bottom cover on the path of the liquid filling cap moving from the usage position to the liquid filling position, the pressing cover is recessed inwardly from an edge away from the liquid filling hole to form a notch, the smoke outlet hole and the liquid filling hole are both received and exposed in the notch; a surface of the pressing cover facing the bottom cover is formed with two first recesses surrounding the notch and a second recess connected between the two first recesses, when the pressing cover is mounted on the bottom cover, the two first recesses and the second recess are enclosed by the bottom cover to form the two sliding grooves and the receiving groove.

6. The upper cover assembly according to claim 5, wherein the bottom cover is provided with a sealing groove around the smoke outlet hole and the liquid filling hole, the upper cover assembly comprises a sealing pad, the sealing pad is received in the sealing groove to seal around the outer periphery of the smoke outlet hole and the liquid filling hole.

7. The upper cover assembly according to claim 1, further comprising a mouthpiece, wherein the mouthpiece is detachably and fixedly connected with the liquid filling cap.

8. The upper cover assembly according to claim 7, wherein the liquid filling cap comprises a through hole, the lower end of the mouthpiece is inserted into the through hole, a cavity for the flow of smoke is formed in the mouthpiece, and the cavity of the mouthpiece communicates with the through hole.

9. An atomizing device comprising the upper cover assembly according to claim 1.

10. The atomizing device according to claim 9, wherein the atomizing device further comprises a base assembly, a liquid storage tube, and an atomizing assembly with an atomizing chamber, the liquid storage tube is sleeved on the base assembly, the liquid storage tube and the base assembly together surrounds a liquid storage chamber for storing cigarette liquid, the atomizing assembly is received in the liquid storage chamber for atomizing the cigarette liquid, the upper cover assembly is disposed at one end of the liquid storage tube opposite to the base assembly.

11. The atomizing device according to claim 10, wherein the base assembly comprises a base with an inner chamber and an air adjusting ring, and the air adjusting ring is rotatably sleeved on the outer circumference of the base.

12. An electronic cigarette comprising a battery device and the atomizing device according to claim 9.

* * * * *